US007344354B2

(12) United States Patent
Lammas et al.

(10) Patent No.: US 7,344,354 B2
(45) Date of Patent: Mar. 18, 2008

(54) METHODS AND APPARATUS FOR OPERATING GAS TURBINE ENGINES

(75) Inventors: Andrew John Lammas, Maineville, OH (US); Steven Mark Ballman, West Chester, OH (US); Daniel Edward Wines, Cincinnati, OH (US); David Lawrence Bedel, Oldenburg, IN (US); Sean Patrick McGowan, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 252 days.

(21) Appl. No.: 11/222,101

(22) Filed: Sep. 8, 2005

(65) Prior Publication Data

US 2007/0053770 A1 Mar. 8, 2007

(51) Int. Cl.
*F01D 9/06* (2006.01)

(52) U.S. Cl. ..... 415/115; 29/889.2; 416/97 R

(58) Field of Classification Search ..... 415/115, 415/116, 119; 29/889.2
See application file for complete search history.

(56) References Cited

U.S. PATENT DOCUMENTS 3,844,110 A * 10/1974 Widlansky et al. ..... 60/39.08
5,143,512 A 9/1992 Corsmeier et al.
5,472,313 A * 12/1995 Quinones et al. ..... 415/115
6,183,195 B1 2/2001 Tremaine
6,382,903 B1 5/2002 Caruso et al.
6,397,604 B2 6/2002 Eldrid et al.
6,435,812 B1 8/2002 DeStefano et al.
6,450,758 B1 9/2002 Schmidt
6,464,461 B2 10/2002 Wilson et al.
6,477,773 B1 11/2002 Wilson et al.
6,506,021 B1 1/2003 Wilson et al.
6,648,592 B2 * 11/2003 Escure et al. ..... 415/115
7,086,830 B2 * 8/2006 Fitzgerald et al. ..... 415/115

* cited by examiner

*Primary Examiner*—Edward K. Look
*Assistant Examiner*—Devin Hanan
(74) *Attorney, Agent, or Firm*—William Scott Andes; Armstrong Teasdale LLP

(57) ABSTRACT

A method of assembling a gas turbine engine that includes providing a rotor assembly including a rotor shaft, an air duct, and a rotor disk that includes a mounting arm, wherein the mounting arm extends radially inward from the rotor disk towards the rotor shaft and coupling a rotor impeller assembly to the mounting arm, wherein the rotor impeller assembly includes a carrier and a plurality of bleed tubes that each extend outwardly from the carrier and are configured to receive bleed air.

18 Claims, 4 Drawing Sheets

METHODS AND APPARATUS FOR OPERATING GAS TURBINE ENGINES

BACKGROUND OF THE INVENTION

This application relates generally to gas turbine engines and, more particularly, to gas turbine engine rotor impeller assemblies.

At least some known gas turbine engines include a multi-stage axial compressor, a combustor, and a turbine coupled together in a serial flow arrangement. Airflow entering the compressor is compressed and directed to the combustor where the air is mixed with fuel and ignited, producing hot combustion gases used to drive the turbine. To facilitate cooling components exposed to heat transfer hot combustion gases entering the turbine, at least some known gas turbine engines channel cooling air towards the turbine and associated components.

Compressor bleed air is often used as a source of cooling air for high pressure turbine blades or is used to pressurize a sump. Some known turbine engines include an impeller assembly that enables cooling air to be extracted from a compressor stage at a desired pressure and temperature. However, within known gas turbine engines the rotor impeller assembly is coupled to the rotor at a bolted joint that joins two adjacent stages. More specifically, in such gas turbine engines to facilitate extraction at a desired pressure and temperature, the bleed air is extracted only from a location in the compressor that is generally coincident with the coupling stage joint to enable the impeller assembly to be secured in a portion prior to the adjacent rotor stages being coupled together. Although such a joint enables the two stages to be coupled together, such bolted joints are not located at the desired location to receive bleed air at a desired pressure and temperature. Furthermore, it is difficult to position the rotor impeller assembly because at such bolted joints because of their location, and as such, such impellers may increase the overall assembly time, overall weight, and may facilitate an increase in disk wear.

BRIEF DESCRIPTION OF THE INVENTION

In one aspect, a method of assembling a gas turbine engine is provided. The method includes providing a rotor assembly including a rotor shaft, an air duct, and a rotor disk that includes a mounting arm that extends radially inward from the rotor disk towards the rotor shaft and coupling a rotor impeller assembly to the mounting arm wherein the rotor impeller assembly includes a carrier and a plurality of bleed tubes that each extend outwardly from the carrier and are configured to receive bleed air.

In another aspect, a rotor assembly for a gas turbine engine is provided. The rotor assembly includes a rotor shaft and at least one rotor disk coupled to the rotor shaft and includes an integral mounting arm extending radially inward towards the rotor shaft. The assembly also includes a rotor impeller assembly coupled to the mounting arm, the rotor impeller assembly includes a carrier and a plurality of bleed tubes extending radially outward from the carrier, each of the plurality of bleed tubes is configured to receive bleed air.

In a further aspect, a gas turbine engine including a rotor assembly is provided. The rotor assembly includes rotor shaft, at least one rotor disk, and a rotor impeller assembly. The at least one rotor disk is coupled to the rotor shaft and includes a mounting arm. The rotor impeller assembly is coupled to the mounting arm, the rotor impeller assembly includes a carrier and a plurality of bleed tubes extending radially outward from the carrier, each of the plurality of bleed tubes is configured to receive bleed air.

DETAILED DESCRIPTION OF THE INVENTION

Figure 1:
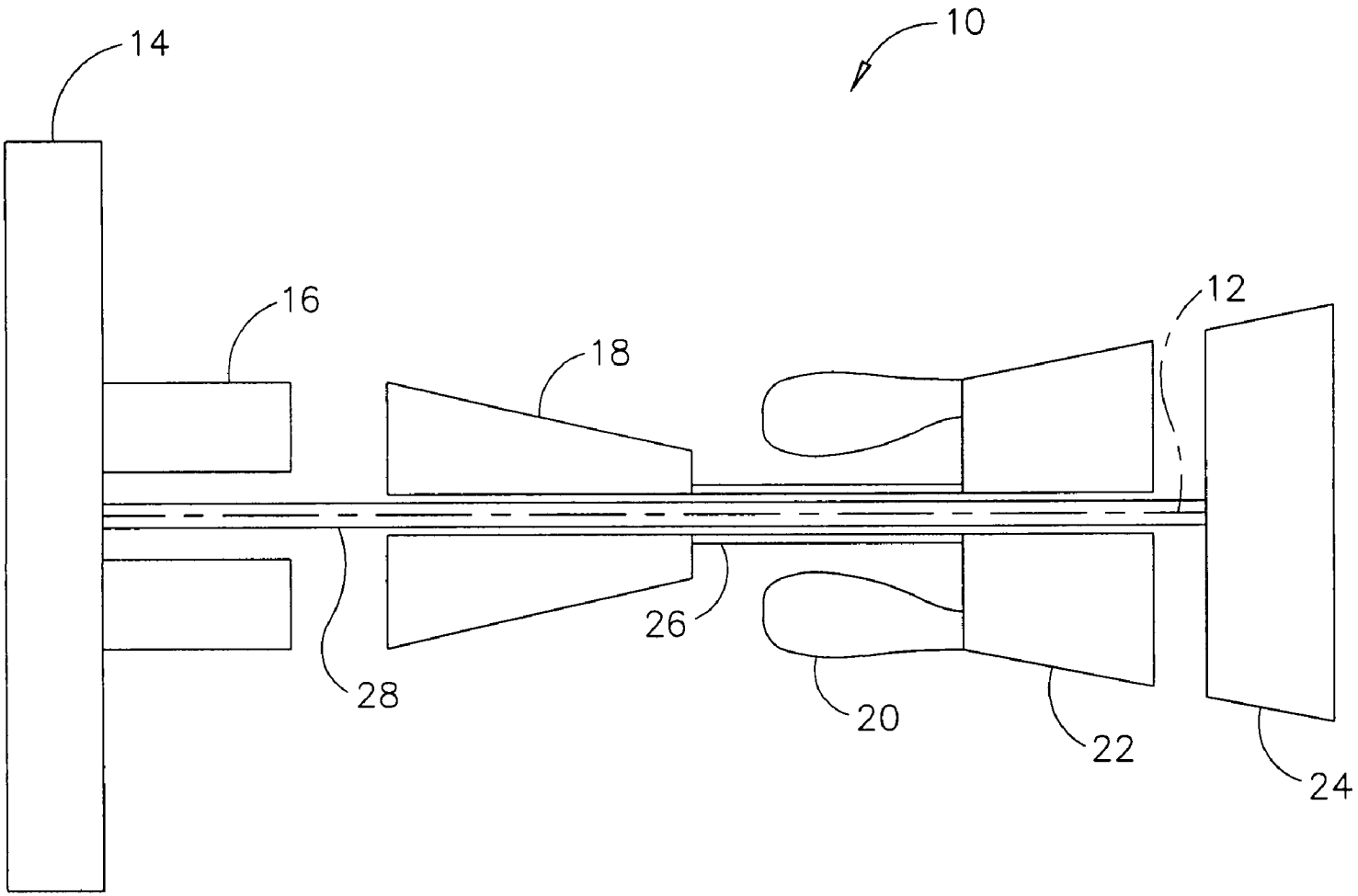
FIG. 1 is a schematic of an exemplary gas turbine engine.

FIG. 1 is a schematic illustration of a gas turbine engine 10. Engine 10 includes, in serial axial flow communication about a longitudinal centerline axis 12, a fan 14, a booster 16, a high pressure compressor 18, and a combustor 20, a high pressure turbine 22, and a low pressure turbine 24. High pressure turbine 22 is drivingly connected to high pressure compressor 18 with a first rotor shaft 26, and low pressure turbine 24 is drivingly connected to both booster 16 and fan 14 with a second rotor shaft 28, which is disposed within first shaft 26. In one exemplary embodiment, the gas turbine engine is an GE90 available from General Electric Company, Cincinnati, Ohio.

In operation, air flows through fan 14, booster 16, and high pressure compressor 18, being pressurized by each component in succession. The highly compressed air is delivered to combustor 20. Airflow from combustor 20 drives turbines 22 and 24 before exiting gas turbine engine 10.

Figure 2:
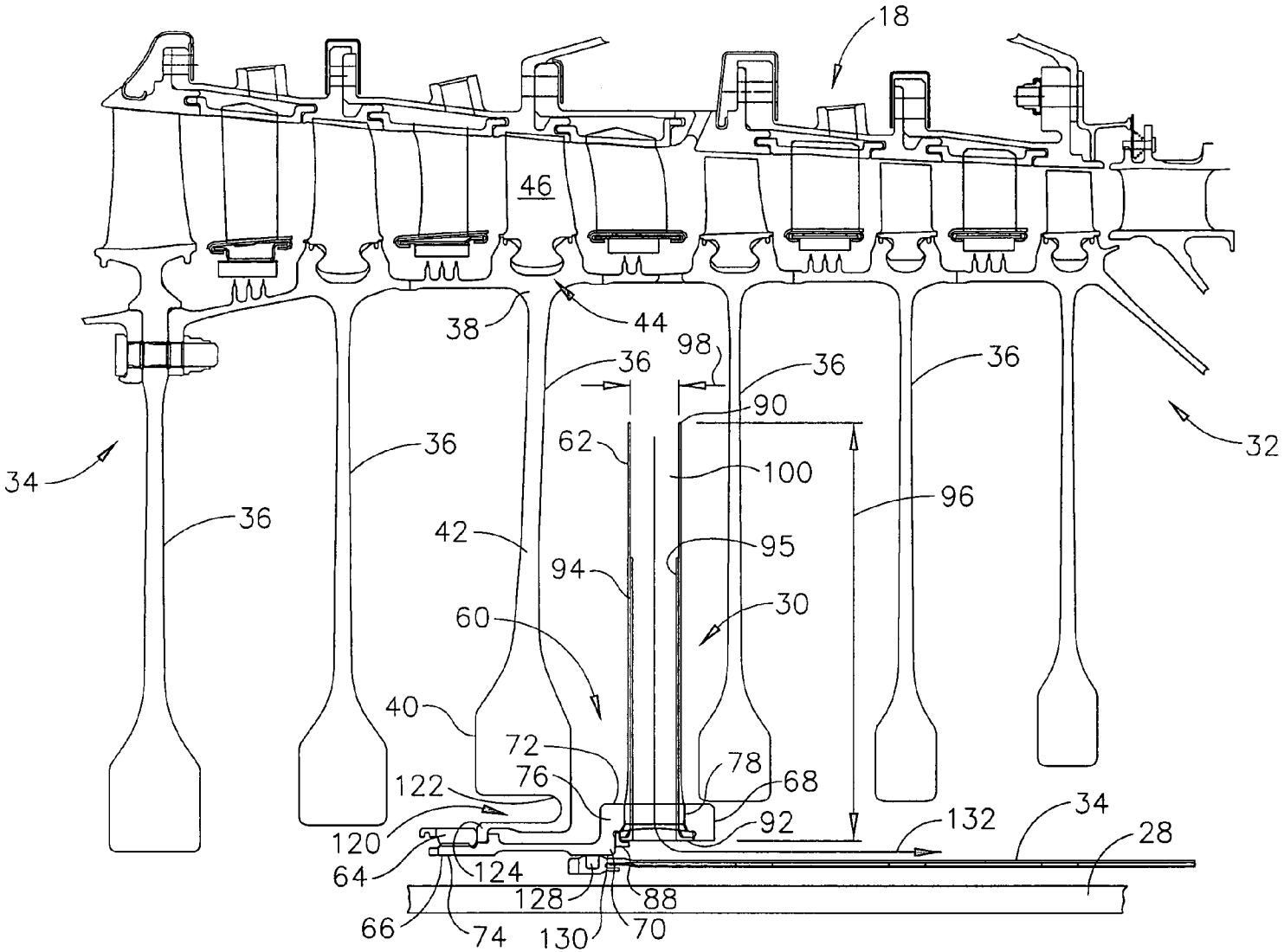
FIG. 2 is a schematic cross-sectional view of a portion of a rotor impeller assembly that may be used with the gas turbine engine shown in FIG. 1.
Figure 3:
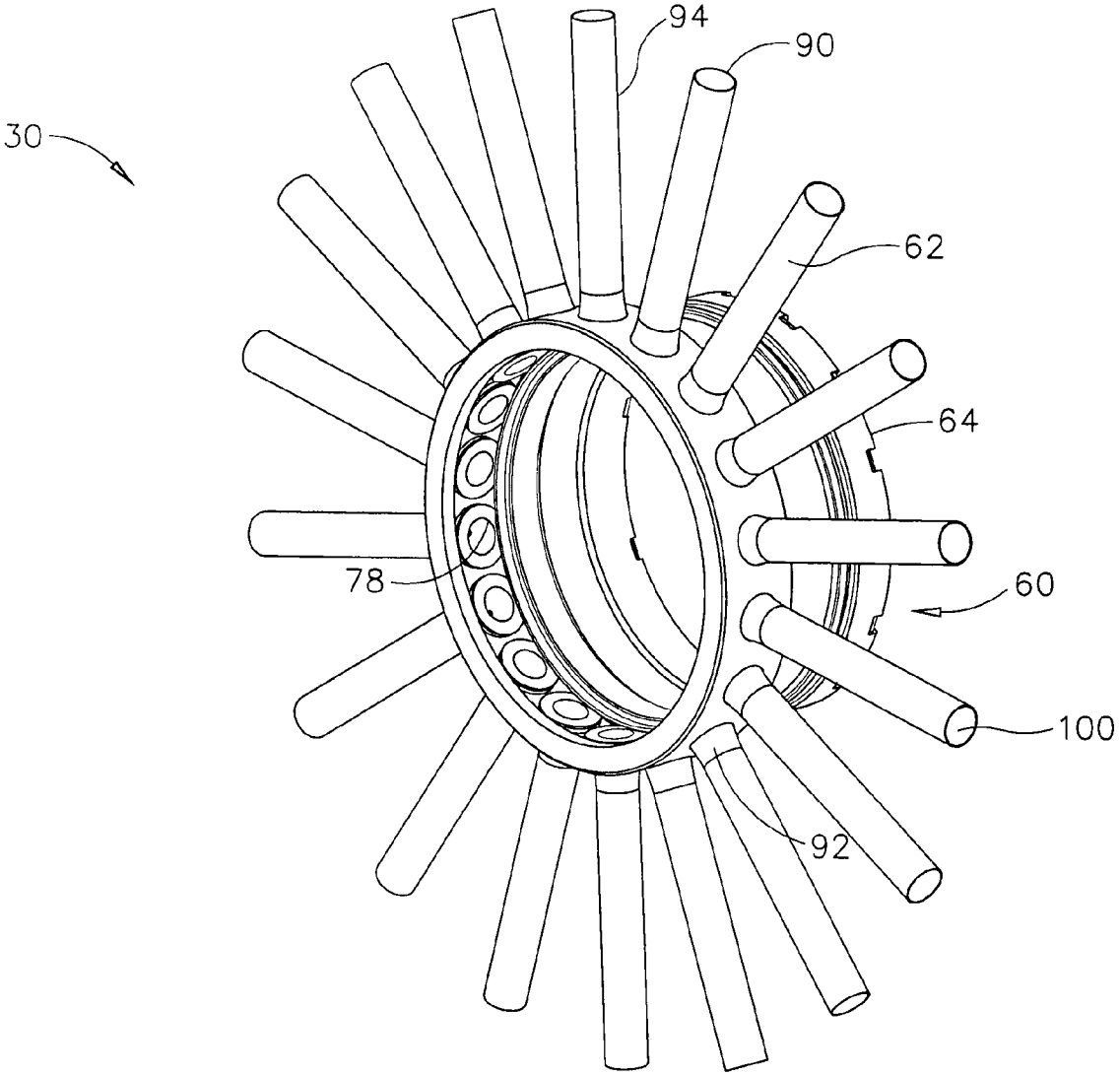
FIG. 3 is a rear perspective view of a portion of the rotor impeller assembly shown in FIG. 2.
Figure 4:
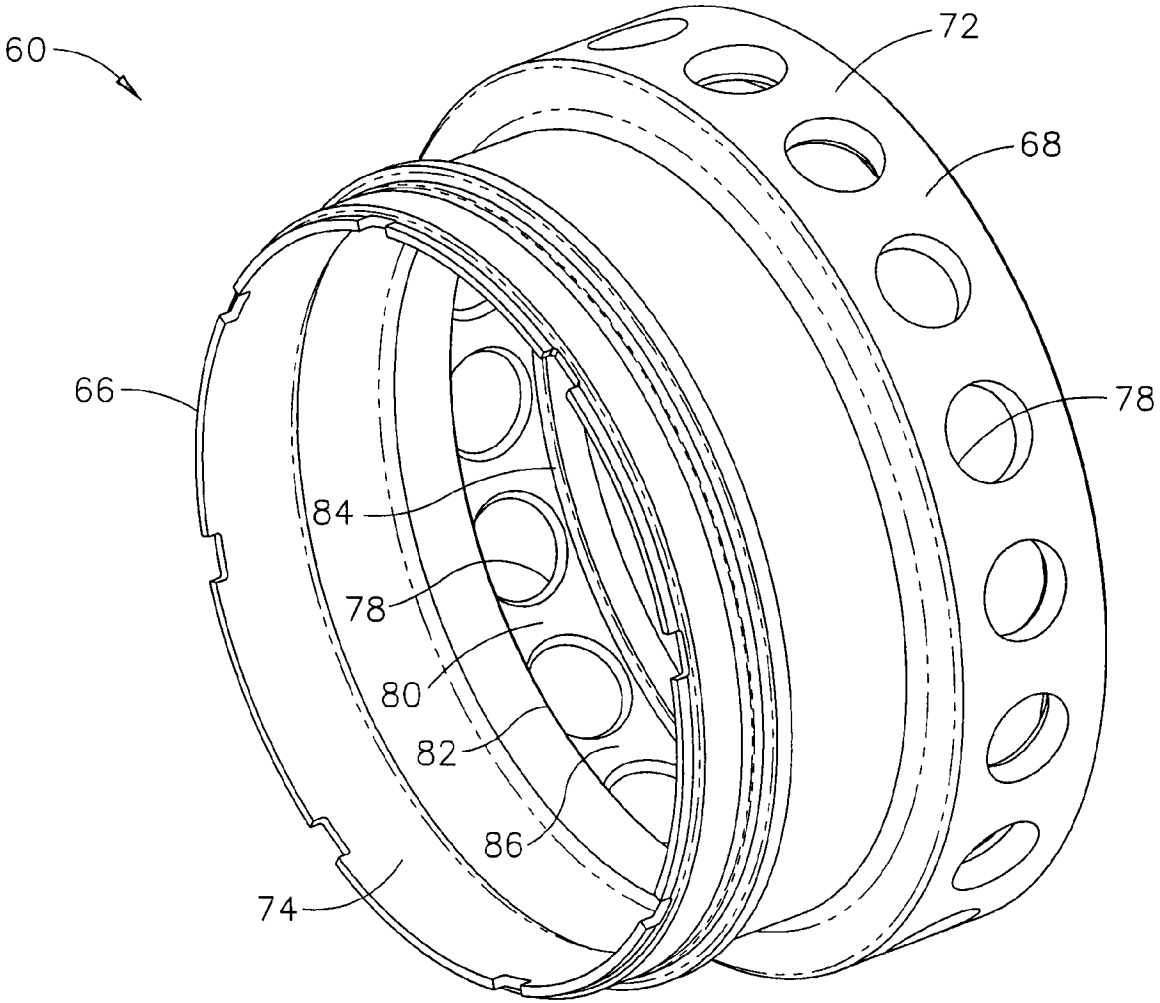
FIG. 4 is a front perspective view of a portion of the rotor impeller assembly shown in FIG. 2.

FIG. 2 is a schematic cross-sectional view of a portion of high pressure compressor 18 including a rotor impeller assembly 30. FIG. 3 is a rear perspective view of a portion of rotor impeller assembly 30 shown in FIG. 2. FIG. 4 is a front perspective view of a portion of rotor impeller assembly 30 shown in FIG. 2. High pressure turbine 22 includes a rotor assembly 32 that includes at least one rotor 34. Rotor 34, as described in more detail below, may be formed by one or more rotor disks 36. A plurality of blades 46 extend radially outward from an outer rim 48 of disk 36 and each disk 36 extends circumferentially around rotor assembly 32. Each row of blades 46 are sometimes referred to as a turbine stage.

In the exemplary embodiment, rotor impeller assembly 30, which is described in greater detail below, extends circumferentially around shaft 28 and is coupled to at least one rotor disk 36. In the exemplary embodiment, rotor impeller assembly 30 is coupled between stage seven and stage eight of rotor blade 36. Additionally, a tubular air duct 34 that is defined at least partially between disks 36 and shaft 28 and extends axially between, and is coupled in flow communication to, rotor impeller assembly 30 for admitting bleed air 132 from compressor 18. Bleed air 132 is channeled into rotor impeller assembly 30 and is then ducted downstream to facilitate cooling high pressure turbine blades 46 or pressurize a downstream sump (not shown).

In the exemplary embodiment, rotor impeller assembly 30 includes a carrier 60, a plurality of bleed tubes 62, and a coupling nut 64. In the exemplary embodiment, carrier 60 includes a coupling portion 66, and a tube carrier portion 68, and an intermediate portion 70 extending generally radially therebetween and radially outward form coupling portion 66. Carrier 60 also includes an outer surface 72, an inner surface 74, and a body 76 extending therebetween. Body 76 has a low profile design such that it may be positioned radially inward from rotor disks 36. Additionally, the design of body 76 facilitates reducing the weight of the rotor assembly 32 and allowing a desired placement of rotor impeller assembly 30 within engine 10.

Tube carrier portion 68 includes a plurality of openings 78 equally circumferentially spaced around carrier 60. Each opening 78 extends between outer surface 72 through a recess 80 within inner surface 74. Each recess 80 has a forward wall 82, and an aft wall 84 and a support wall 86 extending therebetween. Openings 78 and recesses 80 are both configured to receive one bleed tube 62 there through. In the exemplary embodiment, each bleed tubes 62 is removably fastened to body 76 and is oriented substantially perpendicularly to axis of rotation 28 (shown in FIG. 1). In one embodiment, a locking snap ring 88 secures each bleed tube 62 with recess 80 and adjacent body 76. In alternative embodiments, bleed tubes 62 are coupled to rotor impeller assembly 30 by any means that allows it to function as described herein.

Each bleed tube 62 includes a first end 90, a coupling end 92, and a body 94 extending therebetween and extends radially outward from carrier 60 and are circumferentially spaced around carrier 60. In the exemplary embodiment, each bleed tube 62 has an inner tubular body 95 configure to act as a damper. Each bleed tube 62 has a length 96 measured between first end 90 and coupling end 92, and an outer diameter 98 measured at coupling end 92. In the exemplary embodiment, each bleed tube 62 tapers from coupling end 92 towards first end 90. An inner bore 100 extends throughout bleed tube body 94 and body 95 and is in flow communication with opening 78 and air duct 34. Bleed tubes 62 are configured to extend between adjacent disks 36 such that bleed tubes 62 are not in contact with disks 36.

In the exemplary embodiment, carrier 60 is coupled to disk 36 at stage seven by an annular coupling nut 64. In the exemplary embodiment, disk 36 includes a radially outer rim 38, a radially inner hub 40, and an integral web 42 extending generally radially therebetween and radially inward from a respective blade dovetail slot 44. Additionally, disk 36 includes a mounting arm 120 extending radially inward from hub 40 towards shaft 26. Mounting arm 120 includes an arm portion 122 extending radially and axially inward toward shaft 28 and an attachment portion 124 extending forward and substantially parallel to shaft 26. Mounting arm 120 is flexible and as such facilitates reducing the displacement effects on disk 36 during engine operation stress. In the exemplary embodiment, rotor impeller assembly 30 is coupled to disk attachment portion 124 by one annular coupling nut 64 and is coupled to carrier coupling portion 66 by threaded engagement. Coupling nut 64 extends circumferentially around carrier 60 such that attachment portion 124 is secured between coupling nut 64 and carrier coupling portion 66. Coupling nut 64 facilitates positioning rotor impeller assembly 30 without utilizing bolts and/or bolt holes in either carrier 60 or mounting arm 120. Furthermore, coupling nut 64 is positionable radially inward from mounting arm 120. When rotor impeller assembly 30 is coupled to mounting arm 120 by coupling nut 64, a piston ring seal 128 seals a sealing portion 130 on intermediate portion 70 seals carrier inner portion 74 against air duct 34. Impeller assembly 30 is in sealing engagement with air duct 34 such that bleed air 132 is permitted to flow aftward above air duct 34. In an alternative embodiment, bleed 132 is permitted to flow both forward and aftward above air duct 34.

The above-described rotor impeller assembly is cost-effective and highly reliable. The rotor impeller assembly includes a low profile carrier that is configured to facilitate positioning the rotor impeller assembly at an optimum stage for pressure and temperature. Because the rotor impeller assembly utilizes a coupling nut in threaded engagement with the carrier, neither the carrier nor the disk require bolts and/or bolt holes. Accordingly, the rotor impeller assembly thus facilitates reducing rotor assembly weight, manufacturing costs, and disk wear. As a result, the rotor impeller assembly facilitates extending a useful life of the turbine rotor assembly in a cost-effective and reliable manner.

Exemplary embodiments of rotor assemblies and rotor impeller assemblies are described above in detail. The rotor assemblies are not limited to the specific embodiments described herein, but rather, components of each assembly may be utilized independently and separately from other components described herein. For example, each rotor impeller assembly component can also be used in combination with other cooling components and with other rotor assemblies.

While the invention has been described in terms of various specific embodiments, those skilled in the art will recognize that the invention can be practiced with modification within the spirit and scope of the claims.

What is claimed is:

1. A method of assembling a gas turbine engine, said method comprising:

providing a rotor assembly including a rotor shaft, an air duct, and a rotor disk that includes a mounting arm that extends radially inward from the rotor disk towards the rotor shaft; and coupling a rotor impeller assembly to the mounting arm, wherein the rotor impeller assembly includes a cater and a plurality of bleed tubes that each extend outwardly from the carrier and are configured to receive bleed air, said coupling a rotor impeller assembly to the mounting arm further comprising coupling the rotor impeller assembly such that the carrier is positioned radially inward from the at least one rotor disk.

2. A method in accordance with claim 1 wherein coupling a rotor impeller assembly to the mounting arm further comprises coupling the rotor impeller assembly to the mounting arm by an annular coupling nut.

3. A method in accordance with claim 2 wherein coupling a rotor impeller assembly to the mounting arm further comprises coupling the rotor impeller assembly to the mounting arm such that the coupling nut substantially seals with the air duct.

4. A method in accordance with claim 1 wherein coupling a rotor impeller assembly to the mounting arm further comprises coupling the rotor impeller assembly to the mounting arm such that the plurality of bleed tubes are each positioned in flow communication with the air duct.

5. A method in accordance with claim 1 wherein coupling a rotor impeller assembly to the mounting arm further comprises coupling the rotor impeller assembly cater to the mounting arm without utilizing any bolt openings formed within the carrier.

6. A method in accordance with claim 1 wherein providing a rotor assembly including a rotor disk further comprises coupling the plurality of bleed tubes to the carrier such that the bleed tubes extend radially outward from and are spaced circumferentially around the carrier.

7. A rotor assembly for a gas turbine engine including a centerline axis of rotation, said rotor assembly comprising:

a rotor shaft;

at least one rotor disk coupled to said rotor shaft and comprising an integral mounting arm extending radially inward towards said rotor shaft; and a rotor impeller assembly coupled to said mounting arm, and said rotor impeller assembly and comprising a carrier that is radially inward from said at least one rotor disk and a plurality of bleed tubes extending radially outward from said carrier, each of said plurality of bleed tubes configured to receive bleed air.

8. A rotor assembly in accordance with claim 7 wherein said carrier circumscribes said rotor shaft and comprises a first portion, a second portion, and a third portion, said first portion coupled to said mounting arm to secure said rotor assembly thereto, said second portion coupled in sealing arrangement with an air duct extending along said rotor shaft, said third portion coupled to said plurality of bleed tubes.

9. A rotor assembly in accordance with claim 7 wherein said carrier further comprises a plurality of openings circumferentially-spaced around said cater in flow communication with said plurality of bleed tubes.

10. A rotor assembly in accordance with claim 7 wherein said mounting arm further comprises an arm portion extending radially inward towards said rotor shaft and an attachment portion extending substantially parallel to said rotor shaft, said attachment portion is coupled to said carrier by an annular coupling nut.

11. A rotor assembly in accordance with claim 7 wherein said carrier is coupled to said at least one rotor disk without utilizing any bolt openings formed within the carrier.

12. A gas turbine engine comprising a rotor assembly comprising a rotor shaft, at least one rotor disk, and a rotor impeller assembly, said at least one rotor disk coupled to said rotor shaft and comprising a mounting arm, said rotor impeller assembly coupled to said mounting arm, and said rotor impeller assembly and comprising a carrier that is radially inward from said at least one rotor disk and a plurality of bleed tubes extending radially outward from said carrier, each of said plurality of bleed tubes configured to receive bleed air.

13. A gas turbine engine in accordance with claim 12 wherein said rotor impeller assembly further comprises an annular coupling nut, said annular coupling nut is radially inward from said at least one rotor disk and configured to couple said carrier to said mounting arm.

14. A gas turbine engine in accordance with claim 13 wherein said mounting aim further comprises an arm portion extending radially inward towards said rotor shaft and an attachment portion extending substantially parallel to said rotor shaft, said attachment portion is coupled to said carrier by said annular coupling nut.

15. A gas turbine engine in accordance with claim 12 wherein said carrier circumscribes said rotor shaft and comprises a first portion, a second portion, and a third portion, said first portion coupled to said mounting arm to secure said rotor assembly thereto, said second portion coupled in sealing arrangement with an air duct extending along said rotor shaft, said third portion coupled to said plurality of bleed tubes.

16. A gas turbine engine in accordance with claim 12 wherein said carrier further comprises a plurality of openings circumferentially-spaced around said carrier in flow communication with said plurality of bleed tubes.

17. A gas turbine engine in accordance with claim 12 wherein said carrier has a low profile such that said carrier facilitates positioning said rotor impeller assembly at a desired location within said rotor assembly.

18. A gas turbine engine in accordance with claim 12 wherein said carrier is to said at least one rotor disk without utilizing any bolt openings formed within the carrier.

* * * * *

UNITED STATES PATENT AND TRADEMARK OFFICE

CERTIFICATE OF CORRECTION

PATENT NO. : 7,344,354 B2
APPLICATION NO. : 11/222101
DATED : March 18, 2008
INVENTOR(S) : Lammas et al.

It is certified that error appears in the above-identified patent and that said Letters Patent is hereby corrected as shown below:

In Claim 1, column 4, line 37, delete "includes a cater" and insert therefor -- includes a carrier --.

In Claim 5, column 4, line 60, delete "assembly cater" and insert therefor -- assembly carrier --.

In Claim 9, column 5, line 23, delete "said cater" and insert therefor -- said carrier --.

In Claim 14, column 6, line 12, delete "mounting aim" and insert therefor -- mounting arm --.

Signed and Sealed this
Twenty-seventh Day of March, 2012

David J. Kappos

David J. Kappos
*Director of the United States Patent and Trademark Office*